US011149232B2

(12) United States Patent
Delplancke et al.

(10) Patent No.: US 11,149,232 B2
(45) Date of Patent: Oct. 19, 2021

(54) AUTOMATIC DISHWASHING COMPOSITION

(71) Applicant: The Procter & Gamble Company, Cincinnati, OH (US)

(72) Inventors: Patrick Firmin August Delplancke, Steenhuize-Wijnhuize (BE); James Elliot Goodwin, Newcastle upon Tyne (GB); Glenn Steven Ward, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 15 days.

(21) Appl. No.: 16/274,266

(22) Filed: Feb. 13, 2019

(65) Prior Publication Data

US 2019/0256802 A1 Aug. 22, 2019

(30) Foreign Application Priority Data

Feb. 21, 2018 (EP) ..... 18157967
Nov. 21, 2018 (EP) ..... 18207654

(51) Int. Cl.

| | |
|---|---|
| ***C11D 3/10*** | (2006.01) |
| ***C11D 3/30*** | (2006.01) |
| ***C11D 3/37*** | (2006.01) |
| ***C11D 3/386*** | (2006.01) |
| ***B08B 3/04*** | (2006.01) |
| ***C11D 11/00*** | (2006.01) |
| ***C11D 1/42*** | (2006.01) |

(52) U.S. Cl.

CPC ..... *C11D 3/30* (2013.01); *C11D 1/42* (2013.01); *C11D 3/386* (2013.01); *C11D 3/38609* (2013.01); *C11D 11/0023* (2013.01); *C11D 3/10* (2013.01); *C11D 3/3761* (2013.01)

(58) Field of Classification Search

CPC .... C11D 3/10; C11D 3/30; C11D 3/37; C11D 3/386; B08B 3/04

See application file for complete search history.

(56) References Cited

U.S. PATENT DOCUMENTS

| | | | | |
|---|---|---|---|---|
| 2006/0100127 | A1 | 5/2006 | Meier et al. | |
| 2014/0255330 | A1* | 9/2014 | Cron | C11D 1/525 424/65 |
| 2015/0315523 | A1 | 11/2015 | Hulskotter et al. | |
| 2018/0051232 | A1* | 2/2018 | Delplancke | C11D 1/86 |
| 2018/0051233 | A1* | 2/2018 | Delplancke | C11D 3/30 |
| 2018/0051234 | A1* | 2/2018 | Delplancke | C11D 3/30 |
| 2018/0282664 | A1 | 10/2018 | Klug et al. | |

FOREIGN PATENT DOCUMENTS

| | | | | |
|---|---|---|---|---|
| WO | WO9605280 | A1 | 2/1996 | |
| WO | WO00/37627 | A1 | 6/2000 | |
| WO | WO 2005/035707 | * | 4/2005 | C11D 3/39 |

OTHER PUBLICATIONS

Extended European Search Report; Application No. 18157967.3-1106; dated May 7, 2018; 7 pages.
Extended European Search Report and Search Opinion; Application Ser. No. 18157967.3; dated Jul. 5, 2018; 7 pages.
Extended European Search Report and Search Opinion; Application Ser. No. 18207654.7; dated Mar. 14, 2019; 7 pages.

* cited by examiner

*Primary Examiner* — Brian P Mruk
(74) *Attorney, Agent, or Firm* — Abbey A. Lopez

(57) ABSTRACT

A phosphate-free automatic dishwashing composition including an amine and an enzyme.

7 Claims, No Drawings

AUTOMATIC DISHWASHING COMPOSITION

TECHNICAL FIELD

The present invention is in the field of automatic dishwashing. In particular, it relates to a composition comprising an amine. The composition provides good removal of cooked-, baked- and burnt-on soils and/or prevents spotting resulting in good shine.

BACKGROUND OF THE INVENTION

The automatic dishwashing detergent formulator is continuously looking for ways to improve the performance of detergents in particular now that automatic dishwashing detergents do not use phosphate due to environmental considerations. Phosphate-containing detergents provide very good cleaning. There is a continuous effort to try to find phosphate-free detergent compositions with similar or better cleaning performance than phosphate-containing detergents.

Cooked-, baked-, burnt-on soils are among the most difficult soils to remove. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. In particular, cooked-, baked-, burnt-on soils containing proteins, such as meat, egg and dairy products. The removal of cooked-, baked-, burnt-on soils seem to be more difficult when the detergent is phosphate free.

Phosphate-free detergents can be more prone to leave spots on washed items, in particular on glass and plastic items.

The object of the present invention is to provide an automatic dishwashing detergent composition that provides improved removal of cooked-, baked- and burnt-on soils and/or good shine profile in which the washed items do not present spots.

SUMMARY OF THE INVENTION

The present invention is based on the use of a specific amine in an automatic dishwashing detergent composition. It has been unexpectedly found that the amine of the invention improves the removal of cooked-, baked- and burnt-on soils from dishware and/or reduce spotting on dishware.

According to the first aspect of the invention, there is provided a phosphate-free automatic dishwashing cleaning composition comprising an amine and an enzyme. The amine in combination with the enzyme contribute to the removal of cooked-, baked-, burnt-on soils, especially soils containing proteins such as meat, egg, dairy products, etc and the amine and the enzyme can also contribute to the reduction or prevention of spotting on dishware. The dishware washed with the composition of the invention presents good cleaning and/or shine profile.

The amine of the composition and/or method and/or use of the invention is sometimes herein referred to as "the amine of the invention".

The removal seems to be further improved when the composition comprises a complexing agent, preferably a salt of methyl glycine diacetic acid and even further when the composition comprises a protease. Improved removal can be obtained when the pH of the composition as measured in a 1% weight/volume aqueous solution in distilled water at 20° C. is greater than 9, preferably greater than 10. Preferably the pH of the composition is less than 12.

According to the second aspect of the invention, there is provided a method of removing cooked- baked- and/or burnt-on soils from dishware during automatic dishwashing using the composition of the invention.

According to the third aspect of the invention, there is provided the use of an amine in an automatic dishwashing cleaning composition, preferably the composition of the invention, to facilitate the removal of cooked-, baked- or burnt-on soils from dishware in an automatic dishwashing process.

According to the fourth aspect of the invention, there is provided a method of reducing spotting in automatic dishwashing, using the composition of the invention. Dishware cleaned according to the method of the invention is left with a reduced number of spots and very shiny.

According to the last aspect of the invention, there is provided the use of the amine of the invention, preferably the composition of the invention, to reduce spotting in automatic dishwashing.

The elements of the composition of the invention described herein apply mutatis mutandis to the use and method aspects of the invention.

DETAILED DESCRIPTION OF THE INVENTION

The present invention provides an automatic dishwashing cleaning composition comprising an amine and an enzyme. The composition provides good removal of cooked-, baked- and/or burnt-on soils from dishware. The composition can greatly reduce spotting and provides excellent cleaning and shine. There is also provided a method of using the composition of the invention in an automatic dishwasher for the removal of cooked-, baked- and/or burnt-on soils from dishware and for the reduction of spotting. The invention also provides the use of the amine of the invention, preferably the composition of the invention, in an automatic dishwashing composition for the removal of cooked-, baked- and/or burnt-on soils from dishware and/or for the reduction of spotting on dishware.

By "phosphate-free" is herein meant that the composition comprises less than 1%, preferably less than 0.1% by weight of the composition of phosphate.

The term "dishware" includes cookware, tableware and all items that are usually placed in an automatic dishwasher.

By a "residue of a sugar" is herein meant a composition comprising more than 95% of the sugar, preferably more than 99% of the sugar. Equally, by "a residue derived from a sugar" is herein meant a composition comprising more than 95% of the sugar, preferably more than 99% of the sugar.

By "C12/14" is herein meant a mixture of alkyl having 12 and 14 carbon atoms. Preferably, the C12/14 used herein is derived from coconut oil.

As used herein, articles such as "a" and "an" are understood to mean one or more of what is claimed or described.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

Automatic Dishwashing Cleaning Composition

The composition of the invention is phosphate-free and comprises an amine and an enzyme. The composition is preferably free from anionic surfactant. The composition can optionally but preferably comprise a complexing agent, a dispersant polymer, bleach, inorganic builder (preferably carbonate), a non-ionic surfactant, etc.

The composition of the invention preferably has a pH as measured in 1% weight/volume aqueous solution in distilled water at 20° C. of from at least 9, more preferably at least 10 and preferably less than 12.

The composition of the invention preferably has a reserve alkalinity of from about 10 to about 20, more preferably from about 12 to about 18 at a pH of 9.5 as measured in NaOH with 100 grams of product at 20° C. "Reserve alkalinity", as used herein refers to, the ability of an automatic dishwashing composition to maintain an alkali pH in the presence of acid. This is relative to the ability of an automatic dishwashing composition to have sufficient alkali in reserve to deal with any added acid—coming from the water and/or the soils on the dishware—while maintaining the pH.

More specifically, it is defined as the grams of NaOH per 100 cc's, exceeding pH 9.5, in product. The reserve alkalinity for a solution is determined in the following manner.

A pH meter (for example An Orion Model 720A) with a Ag/AgCl electrode (for example an Orion sure flow Electrode model 9172BN) is standardized using pH 7 and pH 10 buffers. A 1% solution of the composition to be tested is prepared in distilled water. The weight of the sample is noted.

The pH of the 1% solution is measured and the solution is titrated down to pH 9.5 using a solution of 0.2N HCL. The reserve alkalinity is calculated in the following fashion:

Reserve Alkalinity=% NaOH×Specific Gravity.

% NaOH=*ml* HCl×Normality of HCl×4'/Weight of Sample Aliquot Titrated

*Equivalent weight of NaOH in the % NaOH equation, derived from:

% NaOH=*ml* HCl×Normality of HCl×Equiv. Weight NaOH×100/1000×Weight of Sample Aliquot Titrated.

Amine

The composition of the invention comprises an amine selected from the group consisting of amine of formula I, amine of formula III and a mixture thereof:

i. an amine of formula I:

R1-N—R2R3 formula I wherein:

R1 is a cyclic or acyclic polyhydroxyhydrocarbyl;

R2 is hydrogen or methyl; and

R3 is a C6 to C30 hydrocarbyl, preferably C6 to C30 alkyl, hydroxyalkyl, alkoxyalkyl, cycloalkyl, aralkyl or alkenyl;

ii. an amine of formula II:

R1-N—R2R3 formula II wherein:

R1 is an acyclic or cyclic polyhydroxyhydrocarbyl; and

R2 and R3 are independently selected from:

hydrogen, wherein R2 and R3 are not both hydrogen;

substituted or unsubstituted C1 to C5 hydrocarbyl, preferably C1 to C3 hydrocarbyl; and acyclic or cyclic polyhydroxyhydrocarbyl as defined for R1;

iii. an amine of formula III:

R1-N—(R2)(CH2CHOH(CH2O)*n*R3) formula III wherein:

R1 and R2 are independently selected from hydrogen, cyclic or acyclic, linear or branched C1 to C10 alkyl, C1 to C10 hydroxyalkyl, polyhydroxyhydrocarbyl, and polyalkoxy of formula (R4-O)xH with R4 being C1-C4 and x is from 1 to 15; preferably x is from 1 to 5, more preferably x is 1;

n is 0 or 1, preferably 1; and

R3 is a C6 to C30 hydrocarbyl, preferably C6 to C30 alkyl, hydroxyalkyl, alkoxyalkyl, cycloalkyl, aralkyl or alkenyl;

iv. and mixtures thereof.

A "hydrocarbyl" is a univalent group formed by removing a hydrogen atom from a hydrocarbon, e.g. ethyl, phenyl.

A "polyhydroxyhydrocarbyl" is a hydrocarbyl with two or more hydroxyl (—OH) groups.

A "polyhydroxyhydrocarbylamine" is a polyhydroxyhydrocarbyl comprising an amine functionality.

It is believed that the amines as described herein improve the removal of cooked-, baked- and/or burnt-on soils and provide improved shine through improved surfactancy, solvency or a combination of both.

In formula I, R1 is an acyclic or cyclic polyhydroxyhydrocarbyl, preferably a linear polyhydroxyhydrocarbyl group. Preferably R1 is a linear C3 to C8 chain with at least two hydroxyl groups, preferably a C4 to C7 chain with at least three hydroxyl groups directly bonded to the carbon atoms of the chain. R1 can include substituents, in particular, alkoxy groups e.g. by etherification of further hydroxyl groups or further polyhydroxyhydrocarbyl, e.g. polyhydroxy alkyl, group(s). R1 preferably includes at least three free hydroxyl groups including such hydroxyl groups on substituents of the basic carbon chain. Alternatively, R1 can be selected from ring structures comprising an internal ether link, the ring comprising at least two or more hydroxyl groups, most preferably the hydroxyl groups are on a carbon atom not connected to the nitrogen in Formula (I). R1 can be an open chain tetratol, pentitol, hexitol or heptitol group or an anhydro e.g. cycloether anhydro derivative of such a group. Preferably R1 is the residue of, or a residue derived from a sugar, particularly a monosaccharide such as glucose, xylose, fructose or sorbitol; a disaccharide such as maltose or sucrose; or a higher oligosaccharide. Preferably, R1 comprises a sugar of the group consisting of glucose, xylose, maltose and mixtures thereof. Preferably, R1 comprises more than 95% of a sugar, more preferably, more than 99% of a sugar. Preferably R1 is the residue of, or a residue derived from a sugar, particularly a monosaccharide such as glucose, xylose, fructose or sorbitol; a disaccharide such as maltose or sucrose; or a higher oligosaccharide. Preferably, R1 is derived from a sugar of the group consisting of glucose, xylose, maltose and mixtures thereof. Preferably R1 comprises more than 95% of a sugar, more preferably, more than 99% of a sugar of the group consisting of glucose, xylose, maltose and mixtures thereof.

Preferred R1 groups for the amine of formula I are derived from glycoses and are of the formula:

—CH2-(CHOH)4-CH2OH formula Ia, e.g. corresponding to residues from glucose, mannose or galactose. It is specially preferred when R1 is derived from glucose. In this case the group —NR1 is of the formula:

—N—CH2-(CHOH)4-CH2OH formula Ib and the group is conveniently called a glycamine group. Most preferably the group R1 will be derived from glucose and the corresponding amines may be called glucamines (as they will usually be made from glucose).

R2 is selected from hydrogen and methyl.

R3 is a C6 to C30 hydrocarbyl, preferably selected from C6 to C30 alkyl, hydroxyalkyl, alkoxyalkyl, cycloalkyl, aralkyl or alkenyl groups. Most preferably R3 is an alkyl group comprising from 6 to 30, preferably from 6 to 20, more preferably from 8 to 18, even more preferably from 8 to 16 and most preferably from 8 to 14 carbon atoms.

The alkyl group can be linear or branched, preferably C1 to C4 branching, more preferably C1 to C3 branching on the 2- or 3-position, preferably 2-position. R3 can also be a substituted alkyl group e.g. a hydroxy or alkoxy substituted alkyl group, particularly a C6 to C30 alkyl group which is hydroxy substituted. The additional hydroxyl group or oxygen atom may provide a modest increase in water solubility. R3 can also be an aralkyl group, particularly a C7 to C12 aralkyl group, such as a benzyl group. Preferably R2 is selected from hydrogen and methyl and R3 from octyl, decyl, 2-propylheptyl dodecyl, tetradecyl and mixtures thereof.

Preferred amine of formula I are linear or branched C6 to C20, more preferably C8 to C14 glucamines, more preferably an amine selected from the groups consisting of N-hexylglucamine, N,N-methyl hexylglucamine, N-octylglucamine, N,N-methyl octylglucamine, N-decylglucamine, N,N-methyl decylglucamine, N-2-ethylhexyl glucamine, N,N-2-ethylhexyl methylglucamine, N-2-propylheptyl glucamine, N,N-2-propylheptyl methyl glucamine, N—C12/14 glucamine, N,N-methyl C12/14 glucamine, N—C16 glucamine, N,N-methyl C16 glucamine and mixtures thereof.

For the amine of formula II, R1 is an acyclic or cyclic polyhydroxyhydrocarbyl, preferably a linear polyhydroxyhydrocarbyl group. Preferably R1 is a linear C3 to C8 chain with at least two hydroxyl groups, preferably a C4 to C7 chain with at least three hydroxyl groups directly bonded to the carbon atoms of the chain. R1 can include substituents, in particular, alkoxy groups e.g. by etherification of further hydroxyl groups or further polyhydroxyhydrocarbyl, e.g. polyhydroxy alkyl, group(s). R1 preferably includes at least three free hydroxyl groups including such hydroxyl groups on substituents of the basic carbon chain. Alternatively R1 can be selected from ring structures comprising an internal ether link, the ring comprising at least two or more hydroxyl groups, most preferably the hydroxyl groups are on a carbon atom not connected to the nitrogen in formula II. R1 can be an open chain tetratol, pentitol, hexitol or heptitol group or an anhydro e.g. cycloether anhydro derivative of such a group. Preferably R1 is the residue of, or a residue derived from a sugar, particularly a monosaccharide such as glucose, xylose, fructose or sorbitol; a disaccharide such as maltose or sucrose; or a higher oligosaccharide. Preferably, R1 comprises a sugar of the group consisting of glucose, xylose, maltose and mixtures thereof. Preferably, R1 comprises more than 95% of a sugar, more preferably, more than 99% of a sugar. Preferably R1 is the residue of, or a residue derived from a sugar, particularly a monosaccharide such as glucose, xylose, fructose or sorbitol; a disaccharide such as maltose or sucrose; or a higher oligosaccharide. Preferably, R1 is derived from a sugar of the group consisting of glucose, xylose, maltose and mixtures thereof. Preferably R1 comprises more than 95% of a sugar, more preferably, more than 99% of a sugar of the group consisting of glucose, xylose, maltose and mixtures thereof. Preferred R1 groups, for amines of formula II, are derived from glycoses and are of the formula:

—CH2-(CHOH)4-CH2OH formula IIa, e.g. corresponding to residues from glucose, mannose or galactose. It is specially preferred when R1 is derived from glucose. In this case the group —NR1 is of the formula:

—N—CH2-(CHOH)4-CH2OH formula IIb, and the group is conveniently called a glycamine group. Most preferably the group R1 will be derived from glucose and the corresponding amines may be called glucamines (as they will usually be made from glucose).

R2 and R3, for the amines of formula II, are independently selected from i) hydrogen, preferably R2 and R3 are not hydrogen at the same time;

ii) substituted or unsubstituted C1 to C3 hydrocarbyl, particularly alkyl, hydroxyalkyl or alkoxyalkyl, in which the alkyl group comprises from 1 to 3, preferably from 1 to 2 carbon atoms; and iii) polyhydroxyhydrocarbyl as defined for R1 in which case the amine function provides two or three hydrophilic polyhydroxy hydrocarbyl groups. In this case, the different groups of the formula R1, R2 and/or R3 will often be (but need not be) the same, as it is usually easier to make the symmetrical polyhydroxyhydrocarbyl substituted amine intermediate.

Especially preferred amine compounds of formula II are selected from the group consisting of N-methyl amino propane diol, N,N-dimethyl amino propane 1,2-diol, N-methylglucamine, N,N-dimethylglucamine, N-ethylglucamine, N,N-diethylglucamine, N-2-hydroxyethylglucamine, and N,N-methyl 2-hydroxyethylglucamine, more preferably N-methylglucamine, N,N-dimethylglucamine, N-ethylglucamine, N,N-diethylglucamine, N-2-hydroxyethylglucamine, N,N-methyl 2-hydroxyethylglucamine and mixtures thereof, most preferably N-methylglucamine, N,N-dimethylglucamine, N-ethylglucamine, N,N-methyl 2-hydroxyethylglucamine and N-2-hydroxyethylglucamine Especially preferred amines for use herein are selected from the group consisting of N,N-dimethylglucamine, N,N-methyl 2-hydroxyethylglucamine and N-hydroxyethylglucamine, and mixtures thereof.

For amines of formula III, when R1 is a polyhydroxyhydrocarbyl, R1 is an acyclic or cyclic polyhydroxyhydrocarbyl, preferably a linear polyhydroxyhydrocarbyl. Preferably R1 is a linear C3 to C8 chain with at least two hydroxyl groups, preferably a C4 to C7 chain with at least three hydroxyl groups directly bonded to the carbon atoms of the chain. R1 can include substituents, in particular, alkoxy groups e.g. by etherification of further hydroxyl groups or further polyhydroxyhydrocarbyl, e.g. polyhydroxy alkyl, group(s). R1 preferably includes at least three free hydroxyl groups including such hydroxyl groups on substituents of the basic carbon chain. Alternatively R1 can be selected from ring structures comprising an internal ether link, the ring comprising at least two or more hydroxyl groups, most preferably the hydroxyl groups are on a carbon atom not connected to the nitrogen in formula III. R1 can be an open chain tetratol, pentitol, hexitol or heptitol group or an anhydro e.g. cycloether anhydro derivative of such a group.

For the amines of formula III, R1 can be a polyhydroxyhydrocarbyl derived from a sugar, preferably a sugar selected from the group consisting of: monosaccharide, disaccharide, or trisacchaside, though a monosaccharide is preferred. While monosaccharides are preferred, disaccharides and trisaccharides can also be present, typically at the ratios present in the sugar from which the polyhydroxyhydrocarbyl is derived. For instance, R1 can be the residue of, or a residue derived from a sugar, particularly a monosaccharide such as glucose, xylose, fructose or sorbitol; a disaccharide such as maltose or sucrose; or a higher oligosaccharide. Preferably, R1 comprises a sugar of the group consisting of glucose, xylose, maltose and mixtures thereof. Preferably, R1 comprises more than 95% of a sugar, more preferably, more than 99% of a sugar. Preferably R1 is the residue of, or a residue derived from a sugar, particularly a monosaccharide such as glucose, xylose, fructose or sorbitol. Preferably, R1 is derived from a sugar of the group consisting of glucose, xylose, maltose and mixtures thereof. Preferably R1 comprises more than 95% of a sugar, more preferably, more than 99% of a sugar of the group consisting of glucose, xylose, maltose and mixtures thereof.

Preferred R1 groups, for the amines of formula III, are derived from glycoses and are of the formula:

—CH2-(CHOH)4-CH2OH formula IIIa, for instance, corresponding to residues from monosaccharides such as glucose, mannose or galactose, preferably glucose. The aldehyde of the monosaccharide is typically eliminated during the reaction to bind the monosaccharide to the amine of formula III. It is specially preferred when R1 is derived from glucose. In this case the group —NR1 is of the formula:

—N—CH2-(CHOH)4-CH2OH formula IIIb, and the group is conveniently called a glycamine group. Most preferably the group R1 will be derived from glucose and the corresponding amines may be called glucamines (as they will usually be made from glucose). The group R1 may comprise, one, two or more glucose units, and the resulting glucamine may be a mixture of monoglucamine (R1 comprises one glucose unit), diglucamine (R1 comprises two glucose units) and triglucamine (R1 comprises three glucose units).

When R1, for the amine of formula III, is a C1 to C10 alkyl, it is preferably an alkyl comprising from 1 to 5, more preferably from 1 to 4, even more preferably from 1 to 2 carbon atoms. Most preferably when R1 is not a polyhydroxyhydrocarbyl, it is hydrogen or methyl.

Most preferably R1 is a polyhydroxyhydrocarbyl.

R2, for the amines of formula III, is preferably selected from the group consisting of hydrogen and C1 to C10 alkyl, particularly when R1 is a polyhydroxyhydrocarbyl. R2 is preferably hydrogen or an alkyl group comprising from 1 to 5, more preferably from 1 to 4 and even more preferably from 1 to 2 carbon atoms. Most preferably R2 is hydrogen or methyl.

For the amines of formula III, when R1 is not a polyhydroxyhydrocarbyl, R1 and R2 are preferably independently selected from hydrogen or an alkyl group comprising from 1 to 5 preferably from 1 to 4 and even more preferably from 1 to 2 carbon atoms. Most preferably R1 and R2 are independently selected from hydrogen or methyl.

For the amines of formula III,

R3 is a C6 to C30 hydrocarbyl, preferably selected from C6 to C30 alkyl, hydroxyalkyl, alkoxyalkyl, cycloalkyl, aralkyl or alkenyl groups. Most preferably R3 is an alkyl group comprising from 6 to 30, preferably from 6 to 20, more preferably from 8 to 18, even more preferably from 8 to 16 and most preferably from 8 to 14 carbon atoms.

The alkyl group can be linear or branched, preferably C1 to C4 branching, more preferably C1 to C3 branching on the 2- or 3-position, preferably 2-position. R3 can also be a substituted alkyl group e.g. a hydroxy or alkoxy substituted alkyl group, particularly a C6 to C30 alkyl group which is hydroxy substituted. The additional hydroxyl group or oxygen atom may provide a modest increase in water solubility. R3 can also be an aralkyl group, particularly a C7 to C12 aralkyl group, such as a benzyl group. Preferably R3 is selected from the group consisting of octyl, decyl, 2-propylheptyl, dodecyl, tetradecyl and mixtures thereof; preferably R3 is decyl, 2-propylheptyl, dodecyl, tetradecyl and mixtures thereof.

The amine selected from amine compounds according to formula III can have the formula wherein:

R1 is a polyhydroxyhydrocarbyl which is preferably derived from a monosaccharide, more preferably glucose, and has the formula:

—CH2-(CHOH)4-CH2OH formula IIIa;

R2 is hydrogen or methyl; and

R3 is selected from the group consisting of: C8 to C14 alkyl and mixtures thereof; preferably R3 is selected from the group consisting of octyl, decyl, 2-propylheptyl, dodecyl, tetradecyl and mixtures thereof; more preferably R3 is decyl, 2-propylheptyl, dodecyl, tetradecyl and mixtures thereof.

Preferred amines of formula III include those in which n is 1, R1 is glucose as such forming a glucamine compound, R2 is methyl and R3 is octyl, decyl, dodecyl and tetradecyl and mixtures thereof.

When R3 is octyl, it is preferably selected from n-octyl, and 2-ethylhexyl. When R3 is decyl, it is preferably selected from n-decyl and 2-propylheptyl.

Other preferred amines of formula III are those in which n is 1, R1 and R2 are methyl and R3 is hexyl, octyl, decyl, dodecyl, tetradecyl and mixtures thereof. When R3 is octyl, it is preferably selected from n-octyl and 2-ethylhexyl. When R3 is decyl, it is preferably selected from n-decyl and 2-propylheptyl.

Mixtures of different amines can have benefits in terms of processing, solubility and performance.

While such amines can have a net positive charge at certain pH, they are typically referred to as nonionic surfactants. However, at low pH (below the pKa of the surfactant) they can have a net positive charge.

The composition of the present invention preferably comprises from 1% to 20% by weight of the composition of the amine, preferably from 2% to 15% by weight of the composition.

Complexing Agent

A complexing agent is a material capable of sequestering hardness ions, particularly calcium and/or magnesium. The complexing agent is preferably selected from the group consisting of citric acid and its salts, methyl-glycine-diacetic acid (MGDA) and its salts, glutamic-N,N-diacetic acid and its salts, iminodisuccinic acid and its salts, carboxy methyl inulin and its salts and mixtures thereof. Especially preferred complexing agent for use herein is a salt of MGDA, in particular the tri-sodium salt of MGDA, especially when the composition has a pH greater than 11 as measured in 1% weight/volume aqueous solution in distilled water at 20° C.

The composition of the invention preferably comprises from about 5 to about 50%, more preferably from about 8 to about 40% by weight of the composition of a complexing agent. Preferably the complexing agent comprises the trisodium salt of MGDA.

Dispersant Polymer

The dispersant polymer, if present, is used in any suitable amount from about 0.1 to about 10%, preferably from 0.2 to about 8%, more preferably from 0.3 to 6% by weight of the composition. Preferably, the composition of the invention comprises a dispersant polymer, more preferably a sulfonated polymer.

The dispersant polymer is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Meettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionised water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water. The preferred dispersant polymers are sulfonated polymers, i.e., polymer comprising sulfonated monomers.

Preferably, the dispersant polymers are sulfonated derivatives of polycarboxylic acids and may comprise two, three, four or more different monomer units. The preferred copolymers contain: At least one structural unit derived from a carboxylic acid monomer having the general formula (III):

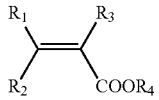

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

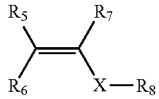

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide;

and at least one structural unit derived from at least one sulfonic acid monomer having the general formula (V) and (VI):

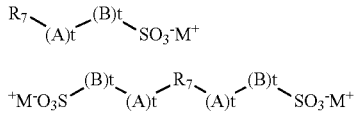

(V)

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol, and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers. Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Preferably, the level of bleach in the composition of the invention is from about 0 to about 10%, more preferably from about 0.1 to about 5%, even more preferably from about 0.5 to about 3% by weight of the composition.

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein are sodium carbonate and silicate. Preferably the composition of the invention comprises from 5 to 50%, more preferably from 10 to 40% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants are useful for use in the composition of the invention. Preferred are C10-C18 alkyl dimethylamine oxide, and C10-18 acylamido alkyl dimethylamine oxide.

Surfactants, in particular non-ionic surfactants, may be present in a level of from 0.1 to 10%, more preferably from 0.2 to 5% and especially from 0.3 to 3% by weight of the composition.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, 5130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A
(ii) S101M+G118V+S128L+P129Q+5130A
(iii) N76D+N87R+G118R+S128L+P129Q+S130A+S188D+N248R
(iv) N76D+N87R+G118R+S128L+P129Q+S130A+S188D+V244R
(v) N76D+N87R+G118R+S128L+P129Q+S130A
(vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 50, more preferably from about 1 to about 45 and especially from about 10 to about 40 mg of active protease. Protease greatly contribute to the removal of cooked-, baked- and burnt-on soils.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:
9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.
(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.2 to 4% and especially from 0.3 to 3% by weight of the composition of a metal care agent, preferably the glass care agent is a zinc containing material, especially hydrozincite.

The composition of the invention can be in any physical form including solid, liquid and gel form. The composition of the invention is very well suited to be presented in unit-dose form, preferably in the form of a multi-compartment pack, more in particular a multi-compartment pack comprising compartments with compositions in different physical forms, for example a compartment comprising a composition in solid form and another compartment comprising a composition in liquid form. The composition if in unit-dose form, is preferably enveloped by a water-soluble film such as polyvinyl alcohol, more preferably the film has a thickness of less than 100 μm.

EXAMPLES

Two dual-compartment automatic dishwashing pouches were made comprising the ingredients detailed herein below (Composition 1 (reference) and Composition 2 (according to the invention)). The pouches were made of polyvinyl alcohol (Monosol 8630 available from Kuraray) with the solid and liquid components in different compartments.

| Ingredients (g of active material) | Composition 1 | Composition 2 |
|---|---|---|
| Solid compartment | | |
| Sodium carbonate | 6.42 | 6.42 |
| Sodium silicate 2R | 0.14 | 0.14 |
| MGDA | 2.84 | 2.84 |
| Sodium percarbonate | 0.94 | 0.94 |
| Sulfonated polymer | 1.07 | 1.07 |
| Protease | 0.035 | 0.035 |
| Amylase | 0.009 | 0.009 |
| Bleach catalyst | 0.001 | 0.001 |
| Miscellaneous | Balance to 13.84 | Balance to 13.84 |
| Liquid compartment | | |
| Lutensol TO7 | 0.70 | 0.70 |
| Plurafac SLF-180 | 1.00 | 1.00 |
| Miscellaneous | Balance to 2.1300 | Balance to 2.1300 |
| Hand Additions | | |
| Amine | — | 2 g |

| | |
|---|---|
| MGDA | Tri-sodium salt of methyl glycine diacetic acid |
| Protease | Ultimase ® Supplied by Dupont |
| Amylase | Stainzyme Plus ® Supplied by Novozymes |
| Lutensol TO7 | Nonionic surfactant supplied by BASF |
| Plurafac SLF-180 | Nonionic surfactant supplied by BASF |

The amine used in Composition 2 is an amine according to formula III, wherein R1 is CH2 (CHOH)4 CH2OH, R2 is Methyl, n is 1 and R3 is n-decyl; The amine of formula III was made by reacting n-decyl derived alkyl glycydyl ether (2-((n-decyl)oxy)oxirane) with N-methyl glucamine. The n-decyl derived alkyl glycydil ether is made by adding epichlorohydrin to the n-decyl alcohol in the presence of a stannic chloride catalyst at 60° C. to yield the crude ether. Water and caustic are added to form the finished ether. The n-decyl derived alkyl glycydyl ether is then purified by decanting the top layer, drying under nitrogen and filtering.

The N-methyl glucamine is added to methanol under stirring to form a suspension, to which is added the n-decyl derived alkyl glycydil ether, with the mixture stirred at 55° C. for 6-24 hours. The methanol is then evaporated away to yield the amine of formula III (6-((2-hydroxy-3-((n-decyl) oxy)propyl)(methyl)amino)hexane-1,2,3,4,5-pentaol).

Performance Data

The cleaning power of the compositions was assessed by running a performance test containing a baked-on, burnt-on soil—specifically burnt macaroni and cheese spots on stainless steel tiles.

Test Protocol

Soil Preparation

To prepare the macaroni and cheese, 1400 ml of water are boiled in a pan on a hob and 135 g of Kraft macaroni and cheese Dinner® dry pasta are added to the boiling water. The pasta is allowed to cook for 7 minutes. In a separate container 226 g of margarine is melted for 1 min in a microwave on high power and 235 ml of whole milk is mixed in, once the pasta is cooked the water is drained and the pasta along with the milk and dried cheese are added into a food processor and blend for 2 minutes, ensuring the mixture is uniform. The stainless tiles are then prepared by painting an even layer of mixture over the standard metal template which is 1 mm thick and has 8 holes drilled out at 7 mm diameter. The template is removed leaving 80 Macaroni cheese spots 7 mm in diameter. The soiled tiles are then put into an oven at 204° C. for 7 minutes.

Running the Test

Each tile is then placed on a benchtop rig containing 4 compartments, each mimicking the spraying action of a full scale ADW machine.

The test is ran at 50° C. using medium water hardness which is typically 8 to 9 gpg. Compositions 1 and 2 are added to 5 litres of water and the resulting solution is used in the rig.

The solutions comprising Composition 1 or 2 are placed in the 4 compartments in the following order A (Composition 1), C (Composition 2), The test is repeated one more time, alternating the order of the compositions in the compartments;

C (Composition 1).

D (Composition 2),

The wash solutions and tiles are placed in each of the benchtop rig compartments, the rig is stopped after 40 minutes.

Analysing the Test

The data is reported as the number of macaroni and cheese spots remaining after 40 mins wash period.

Results

| Treatment | No. Mac n Cheese spots remaining after 40 mins |
|---|---|
| Composition 1 | 50 |
| Composition 2 | 21 |

A significant improvement in the removal of baked-on, burnt-on macaroni cheese is obtained with the composition of the invention (Composition 2).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A phosphate-free automatic dishwashing composition comprising ii) an amine of formula III:

$$R_7—N—(—R_8)(CH2CHOH(CH2O)n\text{-}R_9) \qquad \text{formula III}$$

wherein:

$R_7$ and $R_8$ are independently selected from hydrogen, cyclic or acyclic, linear or branched $C_1$ to $C_{10}$ alkyl, $C_1$ to C10 hydroxyalkyl, polyhydroxyhydrocarbyl and polyalkoxy of formula $(R_{10}—O)xH$ with $R_{10}$ being $C_1$-$C_4$ and x is from 1 to 15;

n is 0 or 1; and $R_9$ is a $C_6$ to $C_{30}$ hydrocarbyl, wherein the composition comprises a protease, an amylase and is free of anionic surfactants, wherein the composition has a pH from at least 10 to below 12, wherein the composition is adapted for use in an automatic dishwashing machine.

2. A composition according to claim 1, wherein the composition comprises an amine of formula III, wherein in said amine of formula III, $R_8$ is selected from the group consisting of: hydrogen and $C_1$ to $C_{10}$ alkyl.

3. A composition according to claim 1, wherein the composition comprises an amine of formula III, wherein in said amine of formula III, $R_8$ is selected from the group consisting hydrogen and methyl.

4. A composition according to claim 1 wherein the composition comprises an amine of formula III, wherein in said amine of formula III, $R_9$ is selected from the group consisting of: $C_6$ to $C_{30}$ alkyl.

5. A composition according to claim 1 wherein the composition comprises from about 1% to about 20% by weight thereof of the amine.

6. A composition according to claim 1 comprising:

a) from about 2 to about 15% by weight of the composition of the amine;

b) a protease;

c) an amylase;

d) from about 5 to about 40% by weight of the composition of a complexing agent;

e) from about 5 to about 40% by weight of carbonate;

from about 1 to about 30% by weight of percarbonate; and g) from 0 to about 10% by weight of the composition of a dispersant polymer.

7. A composition according to claim 1 comprising:

a) from about 2 to about 15% by weight of the composition of the amine;

b) from about 5 to about 40% by weight of the composition of a complexing agent;

c) from about 5 to about 40% by weight of the composition of carbonate;

d) from about 1 to about 30% by weight of the composition of percarbonate; and e) from 0 to about 10% by weight of the composition of a dispersant polymer.

* * * * *